United States Patent [19]

White

[11] 4,313,562

[45] Feb. 2, 1982

[54] FLUE HEAT VENTILATOR

[75] Inventor: Ralph H. White, Burbank, Calif.

[73] Assignee: Modern-Aire Ventilating, Inc., North Hollywood, Calif.

[21] Appl. No.: 191,365

[22] Filed: Sep. 29, 1980

Related U.S. Application Data

[63] Continuation of Ser. No. 14,704, Feb. 23, 1979, abandoned.

[51] Int. Cl.[3] ..... F24B 7/00

[52] U.S. Cl. ..... 237/55; 165/DIG. 2; 165/131; 165/154; 126/101

[58] Field of Search ..... 237/55, 54; 165/DIG. 2, 165/131, 154; 126/11o R, 101; 122/203

[56] References Cited

U.S. PATENT DOCUMENTS

| | | | |
|---|---|---|---|
| 1,791,314 | 2/1931 | Holton | 126/101 X |
| 1,942,211 | 10/1934 | Hartwig | 165/131 |
| 1,996,927 | 4/1935 | Lake | 126/99 R |
| 3,124,197 | 3/1964 | Funk | 165/154 |
| 3,404,674 | 10/1968 | Albert | 126/101 |
| 4,155,505 | 5/1979 | Young | 237/55 X |
| 4,176,709 | 12/1979 | Johnson | 237/55 X |

*Primary Examiner*—Henry C. Yuen
*Assistant Examiner*—Henry Bennett
*Attorney, Agent, or Firm*—William H. Maxwell

[57] ABSTRACT

A heat ventilator for insertion in a flue pipe above stoves and the like, wherein a double walled connector spaces the ventilator from the stove and establishes an annulus heating air delivered into a housing by convection, there being a smooth-walled flue tube extending longitudinally through the housing establishing a passage occupied by a stack of spaced parallel plates transversely disposed and engaged over said flue tube to absorb and dissipate heat into useful air transported by a motor fan through a downwardly open plenum receiving useful air from around said stove and discharging the same over said plates and into a living area.

3 Claims, 6 Drawing Figures

V
H
27
14
40
20
42
22
19
T
21
41
c
30
31
36
37
R
F
4
35
b
25
45
46
23
18
17
P
15
16
a
5
6
13
12
S

FLUE HEAT VENTILATOR

This is a continuation of application Ser. No. 14,704 filed Feb. 23, 1979, now abandoned and entitled FLUE HEAT VENTILATOR.

BACKGROUND

Chimneys and flue pipes are widely used for furnaces, stoves and fireplace installations in order to vent off the products of combustion along with waste heat. Needless to say, great amounts of heat are discharged via the usual chimney and conventional flue pipes, usually as a necessary adjunct to convectin flow for draw. That is, the furnace or stove appliance must have a through flow that will ensure the removal of smoke and its discharge up the chimney or flue. For example, a free standing fireplace or the like is usually joined by a single walled connector flue pipe to chimney sections, while flue pipe that is double or triple walled extends through the building structure and roof in order to isolate heat from the surrounding combustible construction. This chimney or flue pipe is used quite extensively to extend between floors and through attics, and it is this type of heat isolating pipe which is used advantageously herein to replace the ordinary single walled connector pipe and to conserve heat as it travels from the appliance to the ventilator of the present invention. In other words, double walled flue pipe is employed herein to cooperate between the appliance and ventilator. And with the present invention, double walled flue pipe opens to receive useful air at the appliance, and serves to confine the heat of flue gases to the flue tube therethrough while maintaining a relatively cool exterior and ventilator housing.

Heating ventilators for retrieving waste heat have been provided in many forms, characterized by baffles and circuitous routing of either or both the flue gases and useful air to be heated and discharged into a living area. In some instances the flue gases have a straight through flow, and in others a restrictive route that exposes the same to heat transfer elements, and in some instances it is the useful air that is restrictively diverted, or both as stated. It is a general object of this invention to restrict neither body of moving gases and air, and to provide a heat transfer unit having the least impedance to flow in each instance. Highly important is the free flow of flue gases which rely upon convection for the discharge of smoke, and with the present invention the flue gases are transported longitudinally through a straight unobstructed tube with smooth walls. Also highly important is the low pressure high volume delivery of heated useful air in an unobtrusive quiet manner, and with the present invention the heated useful air is transported transversely through a housing comprised of a plurality of straight unobstructed plates with smooth walls.

The unobtrusive delivery of useful air at low pressure and high volume is an object of this invention, and to this end a motor driven fan operates in a plenum and on a transverse axis to transport the useful air to be heated by the aforesaid plates. The plenum opens downwardly to receive the rising convection flow of useful air from the heated area surrounding the appliance, such as a free standing fireplace or the like, and the aforesaid housing is louvered so as to direct the discharge of heated useful air downwardly.

SUMMARY OF INVENTION

This invention relates primarily to stoves and fireplaces of the free standing type wherein smoke and/or flue gases are collected by a hood that discharges into a chimney or flue pipe. The flue pipe is essentially a single walled tube extending upwardly for the rising convection flow of heated gases, projecting through the building structure to discharge over the roof. The axis of discharge is vertical at the appliance, stove or fireplace, either at the top, side or back thereof. Accordingly, the heat ventilator of the present invention is installed in the vertically rising flue pipe, above the appliance and preferably spaced from and closely adjacent thereto. There is a section of double walled flue pipe between the appliance and the ventilator housing to space the latter from the former, and to conserve heat while confining the same for absorption in the ventilator. The housing of the ventilator surrounds a straight section of flue tube onto which a plurality of heat radiating plates are stacked for the transverse transport of useful air to be heated thereby. The back portion of the housing comprises a plenum for useful air intake and its transverse delivery by means of a motor fan, and subsequent discharge at the front portion of housing through downwardly disposed louvers. A substantial amount of heat is extracted from the double walled connector and radiating plates, while the initial convection acceleration of flue gases takes place, all within smooth-walled sections of tube without obstruction of any kind.

DRAWINGS

The various objects and features of this invention will be fully understood from the following detailed description of the typical preferred form and application thereof, throughout which description reference is made to the accompanying drawings, in which.

Figure 1:
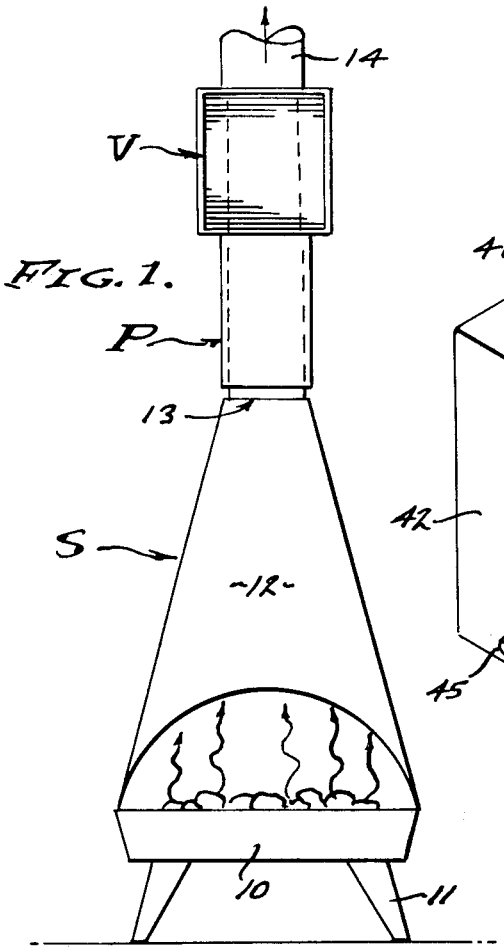
FIG. 1 is a front elevation of a free standing fireplace with the ventilator of the present invention installed thereon.
Figure 2:
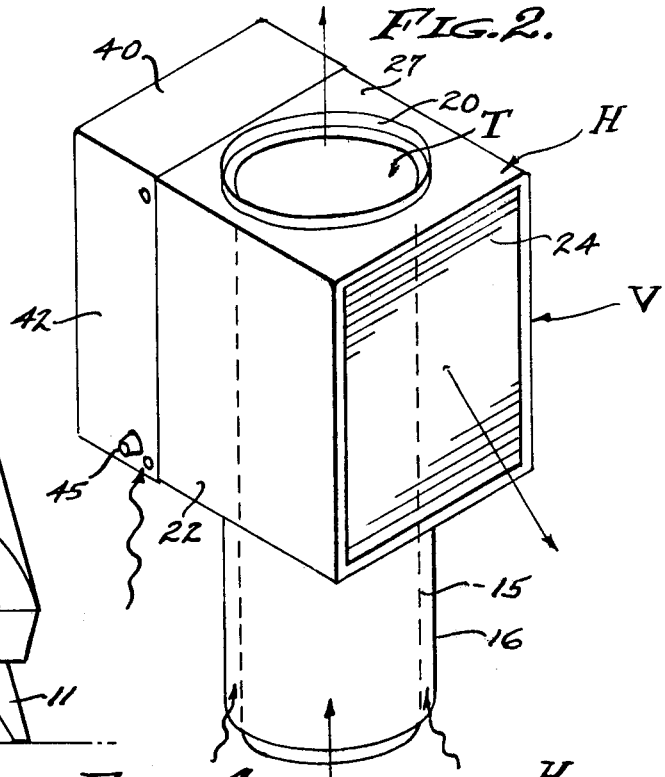
FIG. 2 is a perspective view of the ventilator separated from the fireplace.
Figure 4:
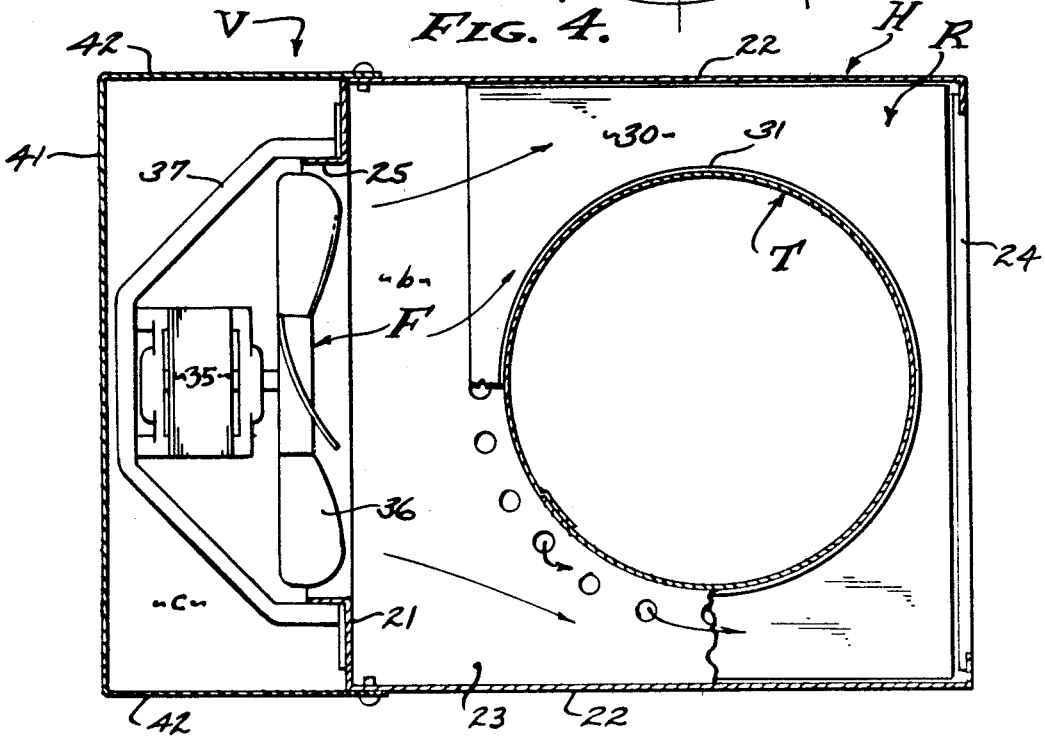
Figures 3, 5, 6:
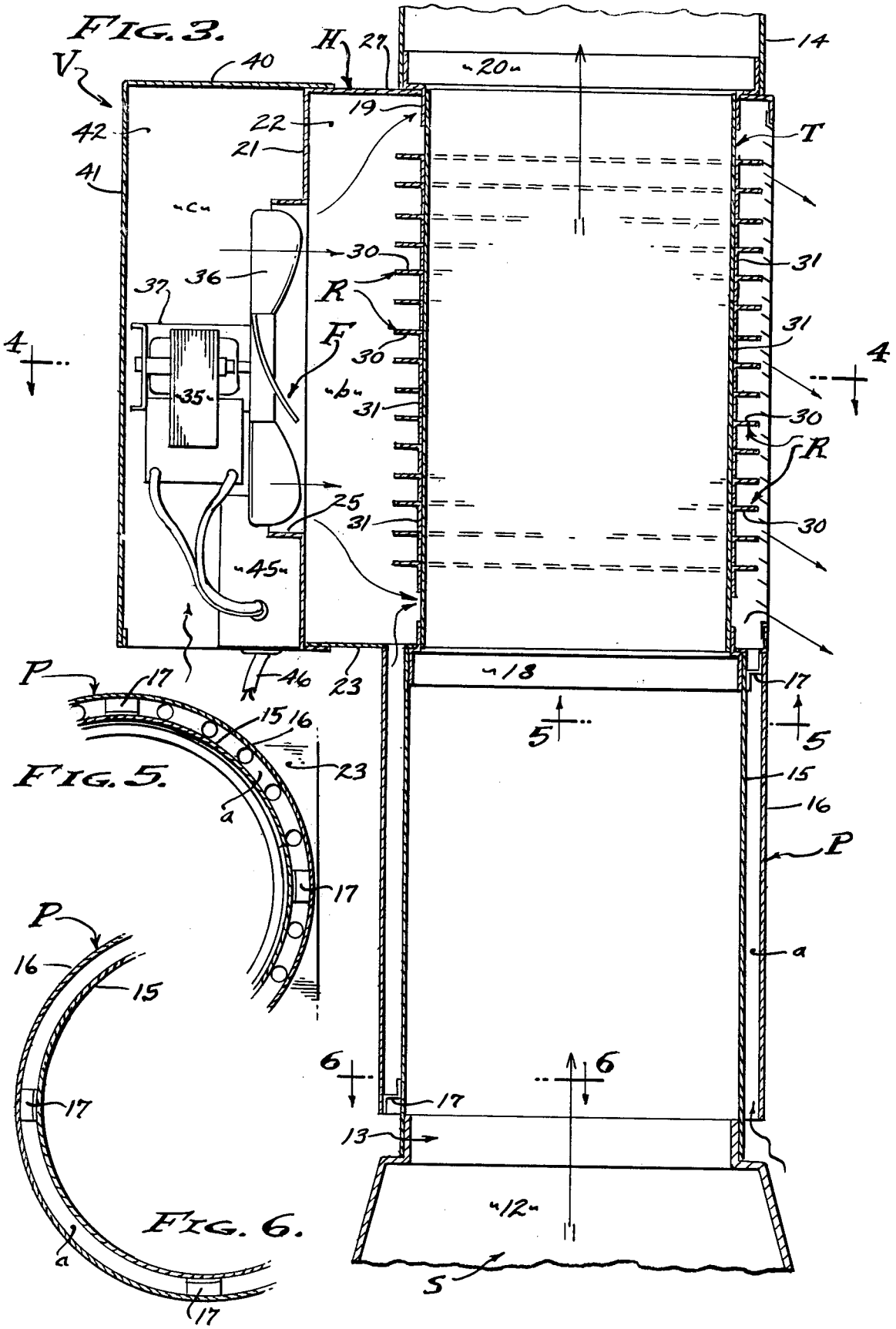
FIG. 3 is an enlarged sectional side elevation of the ventilator.

FIG. 4 is a plan section taken as indicated by line 4—4 on FIG. 3, and FIGS. 5 and 6 are fragmentary sectional views taken as indicated by lines 5—5 and 6—6 on FIG. 3.

PREFERRED EMBODIMENT

The ventilator V disclosed herein is applicable to flue pipes or like chimneys arising from furnaces, stoves and free standing fireplaces and the like. It is sheet metal constructions that are of concern, wherein fire is controlled to produce heat for the interior living space of buildings. As shown, there is a free standing stove or fireplace S comprised of a hearth 10 supported by spaced legs 11, and a hood 12 converging to a flue collar 13 for the discharge of smoke and/or of flue gases into a flue pipe or chimney 14. As shown, the flue pipe 14 is a single walled pipe that extends to or through a suitable fire stop assembly (not shown) or double walled chimney pipe, as may be required. Conventional flue pipe is vertically disposed along the axis of discharge from the appliance fireplace S, and it is this disposition of the ventilator V which is disclosed herein, connected to the flue collar 13 of the appliance by means of a section of double walled connector P supporting the same and confining the heat thereto. A feature is the smooth-walled continuity of the tubular flue sections that carry the flue gases without obstruction.

The connector P telescopically engages onto and over an upwardly standing flange of the flue collar 13, and it comprises an inner tube 15 and an outer tube 16 joined at one or both ends by spreaders 17. As shown, the inner tube 15 is a smooth-walled member telescopically engaged over the collar flange to rest upon the top shoulder of the hood 12, and to telescopically engage into the flue tube of the ventilator as next described. The collar flange is inwardly tapered so as to tightly wedge into the lower end of tube 15, while the top end portion of the tube 15 is tightly wedged onto a coupler flange 18 depending from the ventilator bottom. The outer tube 16 surrounds the inner tube 15 leaving an annulus a therebetween, and it extends from the top of the hood 12 and to the bottom of the ventilator housing as will be described. In practice, the terminal lowermost end of tube 16 is centered and held spaced above the hood 12 and lower end of tube 15 by the spreaders 17, while the upper end of the tube 16 is centered by the spreaders 17 and engaged with the bottom of said housing. It will be seen that convection flow of useful air upward through said annulus a will enter at the lowermost end of tube 16 and will exit at the uppermost end thereof. The spreaders 17 form a spider member or the like disposed between and spot welded to the two tube members.

A housing H and flue tube T are received and supported by the upstanding inner and outer tubes 15 and 16, the housing H to receive warmed convection air from the annulus a, and the tube T to receive smoke and/or the products of combustion from the connector P. The flue tube T is a smooth-walled inwardly stepped continuation of the inner tube 15 of the connector P, adapted to connector tubes of varying diameter by the coupling flange 18. The upper end of the flue tube T is telescopically engaged in a coupling flange 19 with a stepped flange 20 continuing into and entering the flue pipe or chimney 14. Accordingly, the flue tube T is a right cylinder with normal ends and a smooth-walled interior, and a smooth-walled exterior as well for the reception of the radiator plates R as will be described.

In accordance with this invention the housing H is an open front box that surrounds the flue tube T forming a transverse horizontal flow passage for the useful air being heated by the radiator plates R. In practice, the housing H is comprised of an integral wrap-around back 21 and sides 22 joined by a separate bottom 23, and the open front thereof covered by a grill of downwardly turned louvers 24; preferably a screen of expanded sheet metal closely spaced from the flue tube T and with the offset angle thereof turned downward as shown. The back 21 is substantially spaced from the flue tube T to establish a diffuser chamber b, there being a shrouded opening 25 therethrough cooperating with the motor fan as will be described. The bottom 23 of the housing extends horizontally from the back 21 and between the sides 22, with an opening to pass the coupling 19–20 that receives the lowermost end portion of the flue pipe 14 that terminates flush with the top 27. A feature of this invention is the perforated bottom 23 for establishing ventilation from annulus a and into the housing passage surrounding the flue tube T.

In accordance with this invention, the radiator plates R occupy the passage through the housing H, in spaced parallel horizontal relationship disposed between the sides 22, and stopping short of the grill louvers 24 and short of the diffuser b. Each radiator plate R is a rectangular planar member 30, basically square, with a downwardly turned flange 31 spacing the same and permitting a close slide-fit opening to pass the flue tube T, there being a plurality of radiator plates R telescoped onto the flue tube T in stacked relationship one against the other. As shown, the plurality of radiator plates R fully occupy the passage through housing H.

A motor fan F is provided to circulate useful air horizontally and transversely through the housing, and comprises a motor 35 driving a fan 36 centered at or in the shrouded opening 25 and carried by a bracket 37 on the back 21. There is an intake plenum c in which the motor fan F operates and which is established by a cover top 40 that encloses the top of the housing H and with a back 41 that depends to overlie the back 21 in spaced relationship thereto, and with sides 42 extending the sides 22 of the housing, and open at the plane of the bottom 23 to receive the upward draft of useful air from around the appliance. The cover 40–42 is secured to housing H by screw fasteners, as shown. In practice, the back 41 of the cover can be louvered and the sides 42 are fastened to the housing sides by said fasteners for removal and access for servicing. From the foregoing it will be seen that a simple and practical heat ventilator V is provided for installation upon an appliance such as a free standing fireplace, by using the double walled connector P which circulates pre-warmed air into the housing passage occupied by the heat radiator plates R disposed in parallel horizontal relationship for the transverse flow of useful air distributed thereto by the diffuser b and by the motor fan F that receives upward convection flow of pre-warmed air from around said appliance. The rate of flow of useful heated air is by means of a variable motor control 45 at the side of the housing, furnishing electrical power through a cord 36.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A heat ventilator for insertion in a flue pipe and spaced above an open fire place stove and the like having a hood from which heat is radiated into the space being heated, and including; a double walled connector having an inner tube in open communication with said stove and having a closely surrounding outer tube forming an annulus inlet above the stove for upward convection of closely surrounding air from the heated hood and completely surrounding the stove, a longitudinally disposed flue in open communication with the inner tube of the connector and with said flue pipe, a transverse housing above the hood and in open communication with the connector annulus to receive said convection flow of air from the hood completely surrounding the stove and into a passage transversely over the flue tube and having a downwardly open plenum for receiving upward convection flow of heated air from the space being heated at one side of the stove, the housing having a front opening for the discharge of heated air into the space being heated surrounding the stove, transversely disposed spaced and parallel radiator plates engaged over the flue tube and occupying the housing passage to absorb heat from the flue and dissipate the same into the body of air in the housing passage, and a motor driven fan disposed in the plenum of the housing for delivering pre-heated air received from the hood completely surrounding the stove and moving said air over the plates and from the front opening of the housing.

2. A heat ventilator as set forth in claim 1, wherein a back of the housing defines the plenum and a diffuser for the commingled passage of annulus air from the housing passage and through which the motor driven fan delivers said pre-heated air.

3. A heat ventilator as set forth in claim 1, wherein a back of the housing defines a shrouded opening in which the motor driven fan operates to deliver air from the plenum and into a diffuser for the commingled passage of annulus air and plenum air separated by the lowermost of the said radiator plates.

* * * * *